US005894879A

United States Patent [19]

Wyatt-Mair et al.

[11] Patent Number: 5,894,879

[45] **Date of Patent: *Apr. 20, 1999**

[54] METHOD OF MANUFACTURING ALUMINUM ALLOY SHEET

[75] Inventors: Gavin F. Wyatt-Mair, Lafayette; Edwin James Westerman, San Ramon, both of Calif.

[73] Assignee: Kaiser Aluminum & Chemical Corporation, Pleasanton, Calif.

[ * ] Notice: This patent is subject to a terminal disclaimer.

[21] Appl. No.: 08/907,105

[22] Filed: Aug. 5, 1997

Related U.S. Application Data

[63] Continuation of application No. 08/529,644, Sep. 18, 1995, Pat. No. 5,655,593.

[51] Int. Cl.[6] ..... B22D 11/12; B22D 11/124

[52] U.S. Cl. ..... 164/476; 148/552

[58] Field of Search ..... 164/476; 148/551, 148/552, 693, 697; 29/527.7

[56] References Cited

U.S. PATENT DOCUMENTS

| | | | |
|---|---|---|---|
| 3,032,448 | 5/1962 | Siebel et al. | 148/12.7 |
| 4,235,646 | 11/1980 | Neufeld et al. | 148/2 |
| 4,238,248 | 12/1980 | Gyongyos et al. | 148/2 |
| 4,282,044 | 8/1981 | Robertson et al. | 148/2 |
| 4,407,679 | 10/1983 | Manzonelli et al. | 148/2 |
| 4,582,541 | 4/1986 | Dean et al. | 148/2 |
| 4,603,571 | 8/1986 | Wessels | 72/349 |
| 4,614,224 | 9/1986 | Jeffrey et al. | 164/476 |
| 4,711,611 | 12/1987 | Bachmann et al. | 413/69 |
| 4,855,107 | 8/1989 | Teirlinck et al. | 420/546 |
| 4,976,790 | 12/1990 | McAuliffe et al. | 148/2 |
| 5,095,733 | 3/1992 | Porucznik et al. | 72/467 |
| 5,106,429 | 4/1992 | McAuliffe et al. | 148/2 |
| 5,192,378 | 3/1993 | Doherty et al. | 148/691 |
| 5,356,495 | 10/1994 | Wyatt-Mair et al. | 148/551 |
| 5,363,902 | 11/1994 | Kush | 164/485 |
| 5,469,912 | 11/1995 | McAuliffe | 164/476 |
| 5,470,405 | 11/1995 | Wyatt-Mair et al. | 148/551 |
| 5,496,423 | 3/1996 | Wyatt-Mair et al. | 148/551 |
| 5,514,228 | 5/1996 | Wyatt-Mair et al. | 148/551 |
| 5,515,908 | 5/1996 | Harrington | 164/481 |
| 5,531,840 | 7/1996 | Uesugi et al. | 148/552 |
| 5,564,491 | 10/1996 | Harrington | 164/481 |
| 5,616,190 | 4/1997 | Legresy et al. | 148/551 |
| 5,634,991 | 6/1997 | Kamat | 148/551 |

FOREIGN PATENT DOCUMENTS

| | | |
|---|---|---|
| 0640694 | 3/1995 | European Pat. Off. . |
| 2707669 | 9/1993 | France . |
| 28 10 188 | 9/1979 | Germany . |
| 93043777 | 7/1993 | Japan . |
| 93043778 | 7/1993 | Japan . |
| 95047803 | 5/1995 | Japan . |
| WO 94/19129 | 9/1994 | WIPO . |
| WO 96/28582 | 3/1995 | WIPO . |
| WO 97/01652 | 6/1995 | WIPO . |

*Primary Examiner*—Kuang Y. Lin
*Attorney, Agent, or Firm*—Rockey, Milnamow & Katz, Ltd.

[57] ABSTRACT

A method for manufacturing aluminum alloy sheet including a continuous, in-line sequence of forming a strip of aluminum alloy and rolling the strip to reduce its thickness and to cool the strip sufficiently rapidly that precipitation of alloying elements is substantially minimized.

48 Claims, 3 Drawing Sheets

METHOD OF MANUFACTURING ALUMINUM ALLOY SHEET

This is a continuation of application Ser. No. 08/529,644, filed Sep. 18, 1995, now U.S. Pat. No. 5,655,593 issued on Aug. 12, 1997.

BACKGROUND OF THE INVENTION

The present invention relates to a continuous in-line process for economically and efficiently producing aluminum alloy beverage can bodies and cups therefor.

PRIOR ART

It is now conventional to manufacture aluminum cans such as beverage cans in which sheet stock of aluminum in wide widths (for example, 60 inches) is first blanked into a circular configuration and then cupped. The sidewalls are then drawn and ironed by passing the cup through a series of dies having diminishing bores. The dies thus produce an ironing effect which lengthens the sidewall to produce a can body thinner in dimension than its bottom. The resulting can body has thus been carefully designed to provide a shape yielding maximum strength from minimum metal.

One of the problems associated with the current practice in the manufacture of aluminum cans is the problem of earing. Earing is a phenomenon by which the cups and the resulting drawn and ironed cans produced therefrom have irregularly-shaped wall heights. High earing means that the top surface of either the cup or the drawn can varies significantly in height about the circumference of the can. Earing is usually measured in percent, referring to the variation in cup or can height relative to the minimum cup or can height as measured in the valleys between the ears.

Earing is caused, the art has generally recognized, by the uneven distribution of the metal in the wall of either the cup or the can. Techniques to control earing are now well established, and it is typically the practice to control earing in a can body stock containing copper, magnesium, silicon, iron and manganese by means of a fabrication process involving rolling and annealing treatments.

Conventional manufacturing of can body stock employs batch processes which include an extensive sequence of separate steps. In the typical case, a large ingot is cast and cooled to ambient temperature. The ingot is then stored for inventory management. When an ingot is needed for further processing, it is first treated to remove defects such as segregation, pits, folds, liquation and handling damage by machining of its surfaces. This operation is called scalping. Once the ingot has surface defects removed, it is heated to a required homogenization temperature for several hours to ensure that the components of the alloy are properly distributed through the metallurgical structure, and then cooled to a lower temperature for hot rolling. While it is still hot, the ingot is subjected to breakdown hot rolling in a number of passes using reversing or non-reversing mill stands which serve to reduce the thickness of the ingot. After breakdown hot rolling, the ingot is then typically supplied to a tandem mill for hot finishing rolling, after which the sheet stock is coiled, air cooled and stored. The hot rolled coil may be annealed in a batch step, or it may self-anneal by means of the heat retained from hot rolling. The coiled sheet stock is then further reduced to final gauge by cold rolling using unwinders, rewinders and single and/or tandem rolling mills.

It has been proposed, as described in U.S. Patent Nos. 4,260,419 and 4,282,044, to produce aluminum alloy can stock by a process which uses direct chill casting or minimill continuous strip casting. In the process there described, consumer aluminum can scrap is remelted and treated to adjust its composition. In one method, molten metal is direct chill cast followed by scalping to eliminate surface defects from the ingot. The ingot is then preheated, subjected to hot breakdown rolling followed by continuous hot rolling, coiling, batch annealing and cold rolling to form the sheet stock. In another method, the casting is performed by continuous strip casting followed by hot rolling, coiling and cooling. Thereafter, the coil is annealed and cold rolled. The minimill process, as described above, requires about ten material handling operations to move ingots and coils between about nine process steps. Like other conventional processes described earlier, such operations are labor intensive, consume energy and frequently result in product damage. Scrap is generated in the rolling operations resulting in typical losses throughout the process of about 10 to 20%.

In the minimill process, annealing is typically carried out in a batch fashion with the aluminum in coil form. Indeed, the universal practice in producing aluminum alloy flat rolled products has been to employ slow air cooling of coils after hot rolling. Sometimes the hot rolling temperature is high enough to allow recrystallization of the hot coils before the aluminum cools down. Often, however, a furnace coil batch anneal must be used to effect recrystallization before cold rolling. Batch coil annealing as typically employed in the prior art requires several hours of uniform heating and soaking to achieve recrystallization. Alternatively, after breakdown cold rolling, prior art processes frequently employ an intermediate anneal operation prior to finish cold rolling. During slow cooling of the coils following annealing, some alloying elements which had been in solid solution in the aluminum will precipitate, resulting in reduced strength attributable to solid solution hardening.

The foregoing patents (U.S. Pat. No. 4,260,419; and U.S. Pat. No. 4,292,044) employ batch coil annealing, but suggest the concept of flash annealing in a separate processing line. These patents suggest that it is advantageous to slow cool the alloy after hot rolling and then reheat it as part of a flash annealing process. That flash annealing operation has been criticized in U.S. Pat. No. 4,614,224 as not economical.

In co-pending Application Serial No. 07/902,936, filed Jun. 23, 1992, the disclosure of which is incorporated herein by reference, there is disclosed a new concept in the processing of aluminum alloys in the manufacture of aluminum can stock. It is described in the foregoing pending application. It has been discovered that it is possible to combine casting, hot rolling, annealing, solution heat treating, quenching and cold rolling into one continuous, in-line operation in the production of aluminum alloy can body stock. One of the advantages afforded by the process of the foregoing application is that it is possible to operate the continuous, in-line sequence of steps at very high speeds, of the order of several hundred feet per minute. One of the disadvantages that has been discovered in connection with the process of the foregoing application is that the intermediate annealing step, which provides re-solution of soluble elements and earing control through recrystallization of the sheet, may be a limiting factor on the speed at which the process can be operated. Thus, as production speed increases, the continuous annealing furnace preferably used in the practice of the process disclosed in the foregoing application must be made longer and be run at higher energy levels, representing an increase in the cost of capital equipment and the cost in operating the process. It would, therefore, be desirable that the continuous annealing step be avoided.

There is thus a need to provide a continuous, in-line process for producing aluminum alloy can body stock which avoids the unfavorable economics embodied in the use of a continuous annealing furnace.

It is accordingly an object of the present invention to provide a process for producing aluminum alloy can bodies and cups therefrom which can be carried out in a continuous fashion without the need to employ an annealing furnace.

It is a more specific object of the invention to provide a process for commercially producing aluminum alloy can body cups and can bodies in a continuous process which can be operated economically and provide a product having equivalent or better metallurgical properties needed for can making, without excessive earing.

These and other objects and advantages of the invention appear more fully hereinafter from a detailed description of the invention.

SUMMARY OF THE INVENTION

The concepts of the present invention reside in the discovery that it is possible to produce aluminum alloy sheet stock, and preferably aluminum alloy can body stock having desirable metallurgical properties by using, in one continuous sequence of steps, the steps of providing a hot aluminum alloy feedstock which is subjected to a series of rolling steps to rapidly and continuously cool the feedstock to the thickness and metallurgical properties without the need to employ an annealing step conventionally used in the prior art. In similar prior art processes, such as that described in U.S. Pat. No. 4,282,044, it has been suggested that aluminum alloy can body stock can be produced by strip casting, followed by rolling and coiling whereby the rolled feedstock in the form of coils is allowed to slowly cool. Thereafter, the coil is later annealed to improve the metallurgical properties of the sheet stock.

It has been found, in accordance with the present invention, that when the feedstock is rapidly cooled following casting, it is unnecessary to employ annealing steps to attain the desired metallurgical properties resulting from solution of soluble elements. Without limiting the present invention as to theory, it is believed that the rapid cooling effected by the continuous, in-line rolling operations is carried out in a sufficiently short period of time to prevent precipitation of alloying elements contained in the aluminum feedstock as intermetallic compounds. That precipitation reaction is a diffusion-controlled reaction, requiring the passage of time. Where the feedstock is rapidly cooled during rolling, there is insufficient time to permit the diffusion-controlled precipitation from occurring. That, in turn, not only facilitates in-line processing of the aluminum alloy to minimize the number of materials handling steps, so too does the rapid cooling prevent substantial precipitation of alloying elements, making it unnecessary to utilize a high temperature annealing step to attain the desired strength in the final can product.

The feedstock produced by the method of the present invention is characterized as being produced in a highly economical fashion without the need to employ a costly annealing step. As will be understood by those skilled in the art, annealing has been used in the prior art to minimize earing. It has been found, in accordance with the practice of this invention, that, the conditions (time and temperature) of hot rolling, the thickness of the alloy as strip cast and the speed at which it is cast can be used to control earing. For example, casting the aluminum alloy at reduced thickness is believed to reduce earing; similarly, casting at higher speeds can likewise reduce earing. Nonetheless, where use is made of processing conditions which tend to yield an aluminum alloy strip having a tendency toward higher earing, that phenomenon can be controlled by means of an alternative embodiment.

In accordance with that alternative embodiment of the invention, the high earing that can occur on the feedstock can be compensated for by cutting the processed feedstock into non-circular blanks prior to cupping, using what has become known in the art as convoluted die. The use of a convoluted die compensates for any earing tendencies of the sheet stock, by removing metal from those peripheral portions of the blank which would be converted to ears on cup-drawing. Thus, the convoluted die offsets any earing that would otherwise be caused by the omission of high temperature annealing.

In accordance with a preferred embodiment of the invention, the strip is fabricated by strip casting to produce a cast thickness less than 1.0 inches, and preferably within the range of 0.01 to 0.2 inches.

In another preferred embodiment, the width of the strip, slab or plate is narrow, contrary to conventional wisdom; this facilitates ease of in-line threading and processing, minimizes investment in equipment and minimizes cost in the conversion of molten metal to can body stock.

DETAILED DESCRIPTION OF THE INVENTION

The preferred process of the present invention involves a new method for the manufacture of aluminum alloy cups and can bodies utilizing the following process steps in one, continuous in-line sequence:

(a) In the first step, a hot aluminum feedstock is provided, preferably by strip casting; and (b) The feedstock is, in the preferred embodiment, subjected to rolling to rapidly and continuously cool the sheet stock to the desired thickness and attain the desired strength properties.

The cooled feedstock can then be either formed into a coil for later use or can be further processed to form non-circular blanks by means of a convoluted die to effect earing control, in accordance with conventional procedures.

It is an important concept of the invention that the rolling of the freshly cast strip be effected rapidly, before there is sufficient time for the diffusion-controlled reaction by which alloying elements are precipitated from solid solution as intermetallic compounds. In that way, the process of the present invention makes it possible to omit high temperature annealing as is required in the prior art to effect solution of soluble alloying elements. In general, the cast feedstock must be cooled to cold rolling temperatures in less than 30 second, and preferably in less than 10 seconds.

In the preferred embodiment, the overall process of the present invention embodies characteristics which differ from the prior art processes;

(a) The width of the can body stock product is narrow;

(b) The can body stock is produced by utilizing small, in-line, simple machinery;

(c) The tendency of the non-annealed aluminum alloy to exhibit high earing is offset through the use of a convoluted die while achieving desirable strength properties; and (d) The said small can stock plants are located in or adjacent to the can making plants, and therefore packaging and shipping operations are eliminated.

The in-line arrangement of the processing steps in a narrow width (for example, 12 inches) makes it possible for the process to be conveniently and economically located in or adjacent to can production facilities. In that way, the process of the invention can be operated in accordance with the particular technical and throughput needs for can stock of can making facilities.

Figure 1:
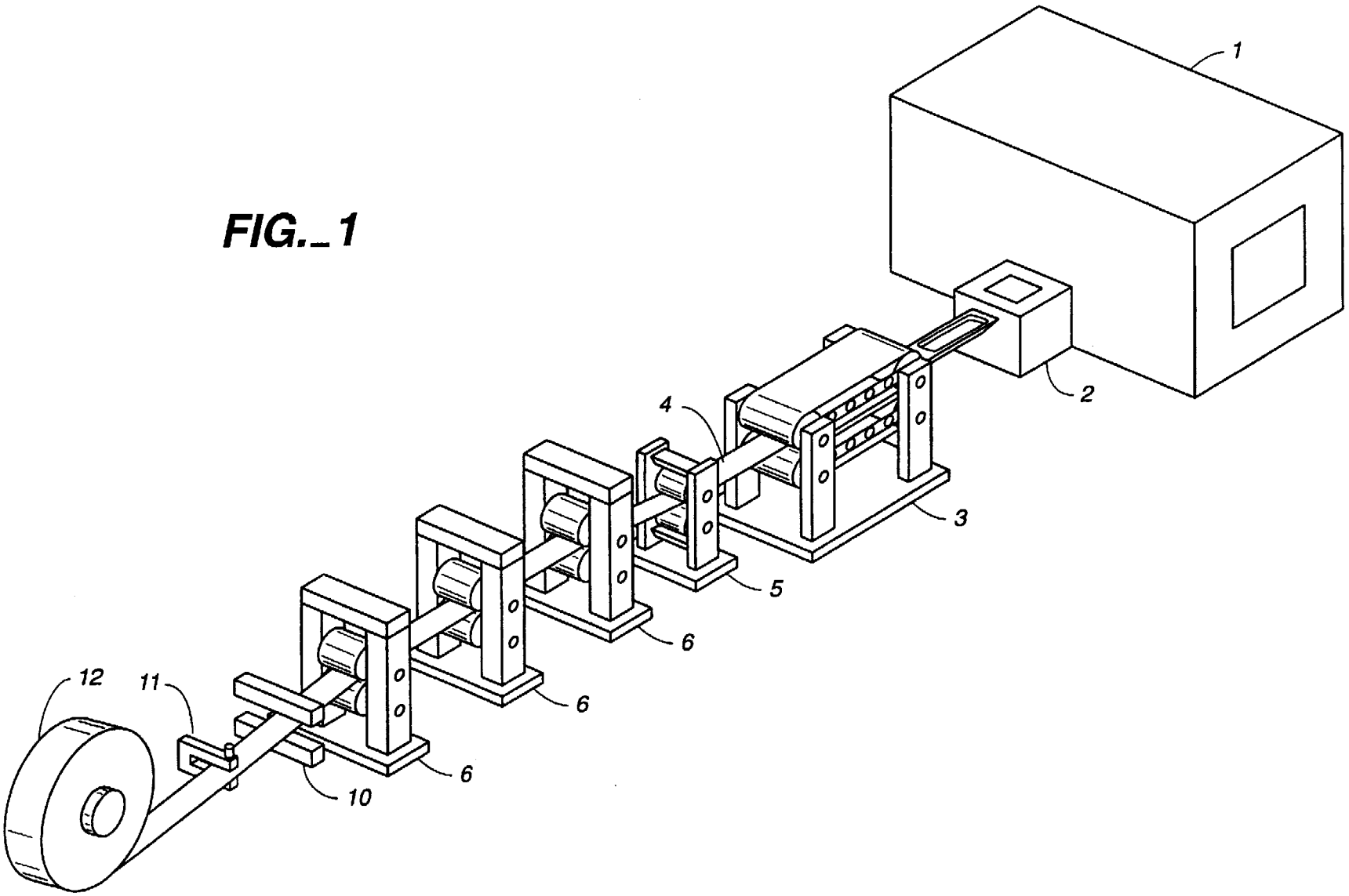
FIG. 1 is a schematic illustration showing the continuous, in-line sequence of steps in producing aluminum alloy sheet stock in accordance with the invention.

In the preferred embodiment of the invention as illustrated in FIG. 1, the sequence of steps employed in the practice of the present invention is illustrated. One of the advances of the present invention is that the processing steps for producing can body sheet can be arranged in one continuous line whereby the various process steps are carried out in sequence. Thus, numerous handling operations are entirely eliminated.

In the preferred embodiment, molten metal is delivered from a furnace 1 to a metal degassing and filtering device 2 to reduce dissolved gases and particulate matter from the molten metal, as shown in FIG. 1 The molten metal is immediately converted to a cast feedstock 4 in casting apparatus 3. As used herein, the term "feedstock" refers to any of a variety of aluminum alloys in the form of ingots, plates, slabs and strips delivered to the hot rolling step at the required temperatures. Herein, an aluminum "ingot" typically has a thickness ranging from about 6 inches to about 30 inches, and is usually produced by direct chill casting or electromagnetic casting. An aluminum "plate", on the other hand, herein refers to an aluminum alloy having a thickness from about 0.5 inches to about 6 inches, and is typically produced by direct chill casting or electromagnetic casting alone or in combination with hot rolling of an aluminum alloy. The term "slab" is used herein to refer to an aluminum alloy having a thickness ranging from 0.375 inches to about 3 inches, and thus overlaps with an aluminum plate. The term "strip" is herein used to refer to an aluminum alloy, typically having a thickness less than 0.375 inches. In the usual case, both slabs and strips are produced by continuous casting techniques well known to those skilled in the art.

The feedstock employed in the practice of the present invention can be prepared by any of a number of casting techniques well known to those skilled in the art, including twin belt casters like those described in U.S. Pat. No. 3,937,270 and the patents referred to therein. In some applications, it is preferable to employ as the technique for casting the aluminum strip the method and apparatus described in co-pending Application Serial Nos. 184,581, filed Jun. 21, 1994, 173,663, filed Dec. 23, 1993 and 173,369, filed Dec. 23, 1990, the disclosures of which is incorporated herein by reference.

Figure 2:
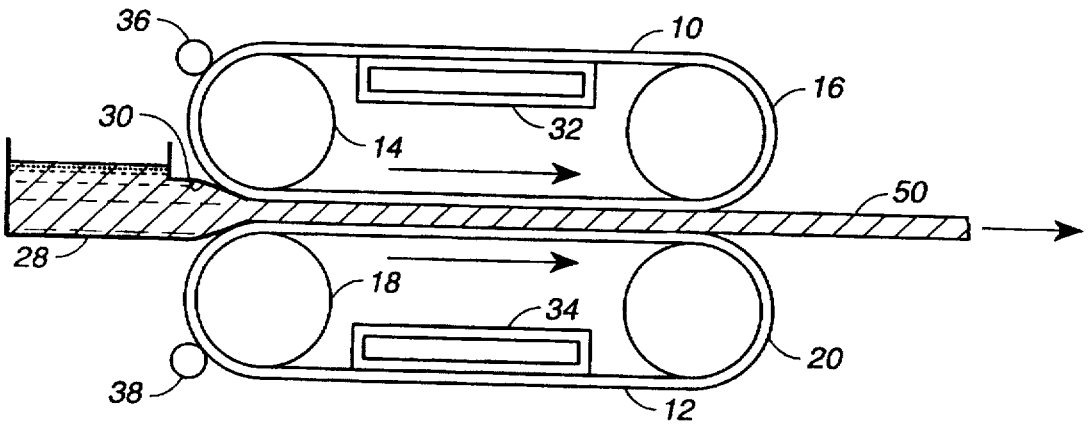
FIG. 2 is a schematic illustration of preferred strip casting apparatus in the practice of the invention.

The strip casting technique described in the foregoing co-pending applications which can advantageously be employed in the practice of this invention is illustrated in FIG. 2 of the drawing. As there shown, the apparatus includes a pair of endless belts 10 and 12 carried by a pair of upper pulleys 14 and 16 and a pair of corresponding lower pulleys 18 and 20. Each pulley is mounted for rotation, and is a suitable heat resistant pulley. Either or both of the upper pulleys 14 and 16 are driven by suitable motor means or like driving means not illustrated in the drawing for purposes of simplicity. The same is true for the lower pulleys 18 and 20. Each of the belts 10 and 12 is an endless belt and is preferably formed of a metal which has low reactivity with the aluminum being cast. Stainless steel or copper are frequently preferred materials for use in the endless belts.

The pulleys are positioned, as illustrated in FIG. 2, one above the other with a molding gap therebetween corresponding to the desired thickness of the aluminum strip being cast.

Molten metal to be cast is supplied to the molding gap through suitable metal supply means such as a tundish 28. The inside of the tundish 28 corresponds substantially in width to the width of the belts 10 and 12 and includes a metal supply delivery casting nozzle 30 to deliver molten metal to the molding gap between the belts 10 and 12.

The casting apparatus also includes a pair of cooling means 32 and 34 positioned opposite that position of the endless belt in contact with the metal being cast in the molding gap between the belts. The cooling means 32 and 34 thus serve to cool belts 10 and 12, respectively, before they come into contact with the molten metal. In the preferred embodiment illustrated in FIG. 2, coolers 32 and 34 are positioned as shown on the return run of belts 10 and 12, respectively. In that embodiment, the cooling means 32 and 34 can be conventional cooling devices such as fluid nozzles positioned to spray a cooling fluid directly on the inside and/or outside of belts 10 and 12 to cool the belts through their thicknesses. Further details respecting the strip casting apparatus may be found in the foregoing co-pending applications.

The feedstock 4 is moved through optional pinch rolls 5 into one or more hot rolling stands 6 where its thickness is decreased. In addition, the rolling stands serve to rapidly cool the feedstock to prevent or inhibit precipitation of the strengthening alloying components such as manganese, copper, magnesium and silicon present in the aluminum alloy.

Figure 3:
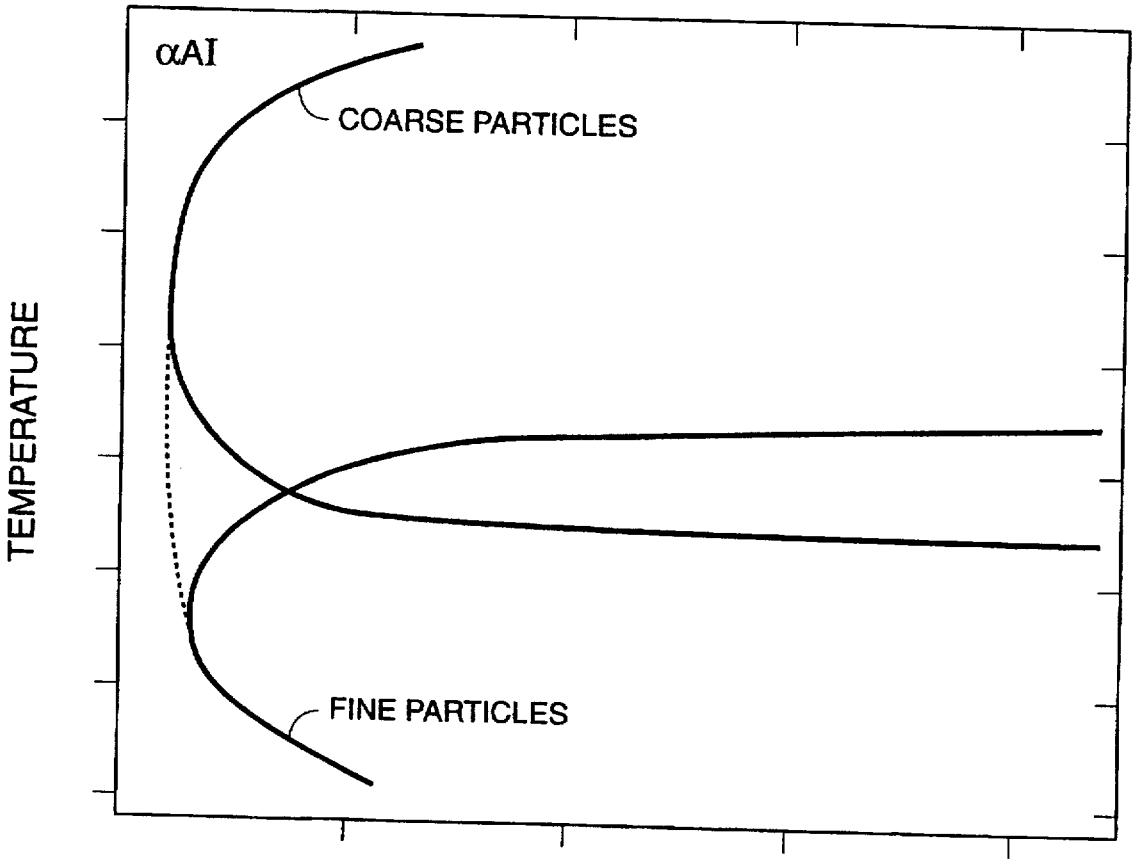
FIG. 3 is a generalized diagram of temperature versus time for aluminum alloy illustrating how rapid cooling serves to eliminate or at least minimize precipitation of alloying elements.

As will be appreciated by those skilled in the art, use can be made of one or more rolling steps which serve to reduce thickness of the strip 4 while simultaneously rapidly cooling the strip to avoid precipitation of alloying elements. The exit temperature from the strip caster 3 varies within the range of about 700° F. to the solidus temperature of the alloy. The rolling operations rapidly cool the temperature of the cast strip 4 to temperatures suitable for cold rolling, generally below 350° F. in less than 30 seconds, and preferably in less than 10 seconds, to ensure that the cooling is effected sufficiently rapidly to avoid or substantially minimize precipitation of alloying elements from solid solution. The effect of the rapidly cooling may be illustrated by reference to FIG. 3 of the drawing, showing the formation of intermetallic precipitates in aluminum as a function of temperature and time. It is importance in the practice of the present invention to rapidly cool the feedstock during the rolling operations so that the strip 4 is cooled along a temperature time line that does not intersect the curves shown on FIG. 3 of the drawing. The prior art practice of allowing a slow cool of, for example, a coil, results in a temperature time line which intersects those curves, maintaining that the slow cooling causes precipitation of alloying elements as intermetallic compounds.

In an alternate embodiment, the feedstock can be passed from where it is cooled to one or more cold rolling stands where the feedstock is worked to harden the alloy and reduce its thickness to finish gauge. After cold rolling, the strip or slab is coiled on a coiler.

As will be appreciated by those skilled in the art, it is possible to realize the benefits of the present invention without carrying out the cold rolling step as part of the in-line process. Thus, the use of the cold rolling step is an optional process step of the present invention, and can be omitted entirely or it can be carried out in an off-line fashion, depending on the end use of the alloy being processed.

The effect of the reductions in thickness likewise effected by the rolling operations are subject to wide variation, depending upon the types of feedstocks employed, their chemistry and the manner in which they are produced. For that reason, the percent reduction in thickness of the rolling operations is not critical to the practice of the invention. In general, good results are obtained when the rolling operation effects a reduction in thickness within the range of 40 to 99 percent of the original thickness of the cast strip and the cold rolling effects a reduction within the range of 20 to 75%.

Figure 4:
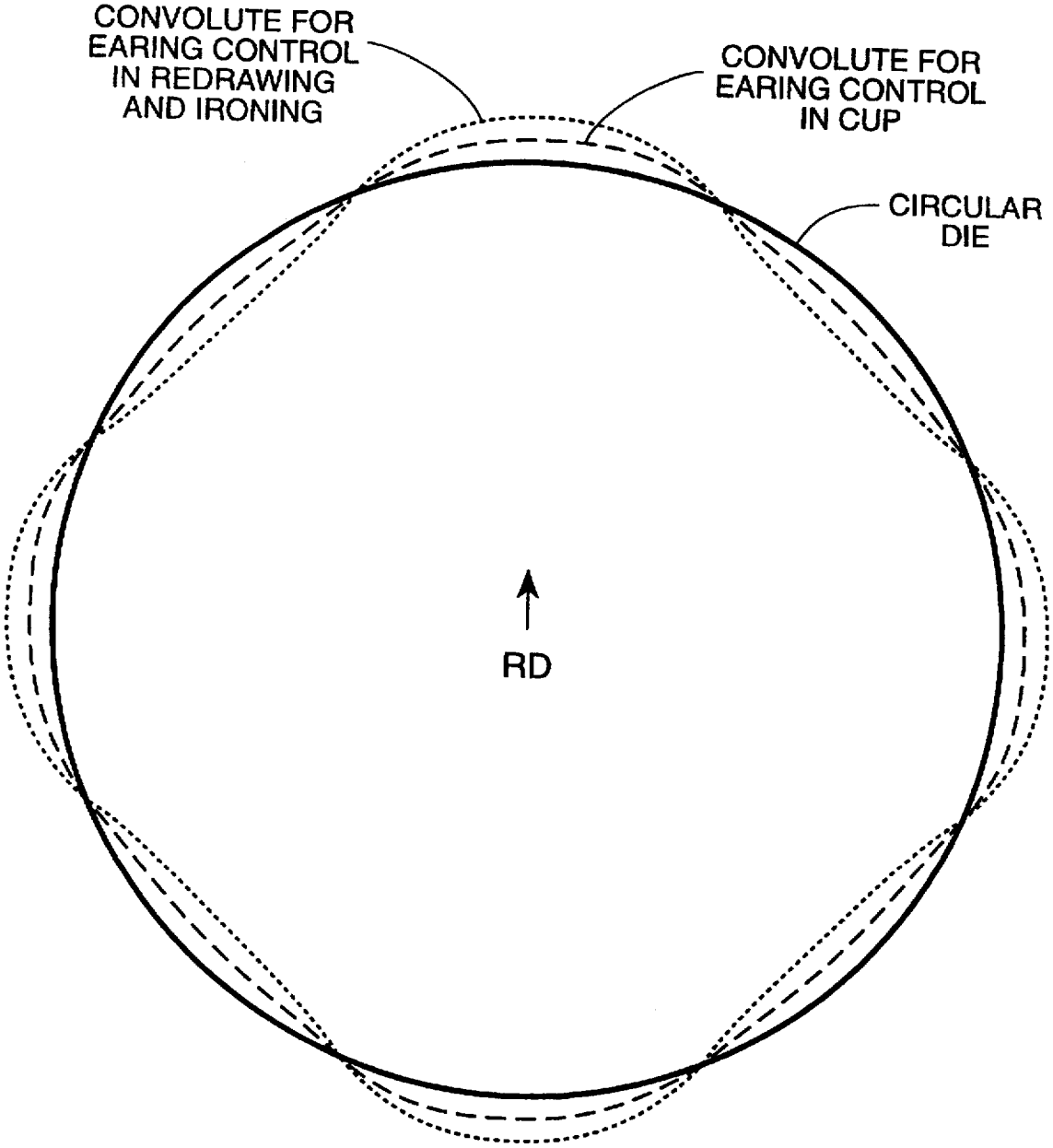
FIG. 4 is a drawing of a blank produced with a convoluted die to control earing in accordance with another embodiment of the invention.

Alternatively, it is preferred to immediately cut blanks using a convoluted die and produce cups for the manufacture of cans instead of coiling the strip or slab 4. Convoluted dies useful in the practice of the present invention are known to the art, and are described in U.S. Pat. Nos. 4,711,611 and 5,095,733. Such dies are now conventional and well known to those skilled in the art. The convoluted dies used in the practice of this invention may be used to form a non-circular blank having the configuration shown in FIG. 4 which in turn can be used to form a cup having the configuration shown in the same Figure. Thus, the convoluted die can be used, where necessary, to minimize earing tendencies of the sheet stock.

As will be appreciated by those skilled in the art, it is also possible, before treating the sheet stock with a convoluted die, to coil the sheet stock.

The concepts of the present invention are applicable to a wide range of aluminum alloys for use as can body stock. In general, alloys suitable for use in the practice of the present invention are those aluminum alloys containing from about 0 to about 0.6% by weight silicon, from 0 to about 0.8% by weight iron, from about 0 to about 0.6% by weight copper, from about 0.2 to about 1.5% by weight manganese, from about 0.2 to about 4% by weight magnesium, from about 0 to about 0.25% by weight zinc, with the balance being aluminum with its usual impurities. Representative of suitable alloys include aluminum alloys from the 3000 and 5000 series, such as AA 3004, AA 3104 and AA 5017.

Having described the basic concepts of the invention, reference is now made to the following examples which are provided by way of illustration of the practice of the invention.

EXAMPLE 1

A sheet of finish gauge can stock which was not annealed was formed into a cup using a conventional round die. The earing was measured as 6.6%.

An adjacent sheet from the same processing (still without an anneal) was formed into a cup with a convolute cutedge on the blanking die. The earing was measured as 3.1%.

EXAMPLE 2

A thin strip of metal 0.09 inch thick was cast at 300 feet per minute and immediately rolled in three passes at high speed from 0.090 inch thick to 0.0114 inch thick while decreasing in temperature during rolling from 900° F. to 300° F. The earing of the sheet so produced was 3.8%. The ultimate tensile strength of the sheet was 43,400 psi and the elongation 4.4%.

It will be understood that various changes and modifications can be made in the details of procedure, formulation and use without departing from the spirit of the invention, especially as defined in the following claims.

What is claimed is:

1. A method for manufacturing an aluminum alloy sheet in a continuous, in-line, one step process, comprising: strip, or slab casting an aluminum alloy feedstock to form a slab or a strip; and rolling to a final product gauge which does not require additional rolling; the process is conducted without intermediate heating that causes recrystallization; wherein the aluminum alloy is rapidly cooled along a temperature time line that does not intersect the curves shown on FIG. 3 to prevent substantial precipitation of alloying elements.

2. A method for manufacturing an aluminum alloy sheet in accordance with claim 1 wherein the cast slab is less than 1 inch thick.

3. A method for manufacturing an aluminum alloy sheet in accordance with claim 1 wherein the cast strip is between 0.01 and 0.2 inches thick.

4. A method for manufacturing an aluminum alloy sheet in accordance with claim 1 wherein the final product gauge is about the same as that for can body sheet or blanks used for cups.

5. A method for manufacturing an aluminum alloy sheet in accordance with claim 1 wherein the total reduction of the thickness of the strip by rolling is 40–99%.

6. A method for manufacturing an aluminum alloy sheet in accordance with claim 1 wherein the final product gauge of the strip is less than 0.12 inch.

7. A method for manufacturing an aluminum alloy sheet in accordance with claim 1 wherein the final product gauge of the strip is about 0.0114 in.

8. A method for manufacturing an aluminum alloy sheet in accordance with claim 1 wherein the final product gauge of the strip is less than about 0.054 in.

9. A method for manufacturing an aluminum alloy sheet in accordance with claim 1 wherein the rolling comprises hot rolling.

10. A method for manufacturing an aluminum alloy sheet in accordance with claim 1 wherein the slab or strip is cooled during the hot rolling.

11. A method for manufacturing an aluminum alloy sheet in accordance with claim 1 wherein the slab or strip is cooled to below 350° F. upon exiting the rolling operation.

12. A method for manufacturing an aluminum alloy sheet in accordance with claim 1 wherein the slab or strip is cooled to below 405° F. upon exiting the rolling operation.

13. A method for manufacturing an aluminum alloy sheet in accordance with claim 1 wherein the time required to cool the a slab or strip is less than 30 seconds.

14. A method for manufacturing an aluminum alloy sheet in accordance with claim 1 wherein the time required to cool the a slab or strip is less than 10 seconds.

15. A method for manufacturing an aluminum alloy sheet in accordance with claim 1 wherein the rolling comprises cold rolling.

16. A method for manufacturing an aluminum alloy sheet in accordance with claim 1 wherein the rolling comprises hot rolling and cold rolling.

17. A method for manufacturing an aluminum alloy sheet in accordance with claim 8 wherein the rolled slab or strip is coiled after rolling.

18. A method for manufacturing an aluminum alloy sheet in accordance with claim 4 wherein a convoluted die is employed to cut non-circular blanks from the strip.

19. A method for manufacturing an aluminum alloy sheet in accordance with claim 8 wherein the aluminum alloy comprises from about 0 to 0.6% by weight silicon, from 0 to about 0.8% by weight iron, from 0 to about 0.6% by weight copper, from about 0.2 to about 1.5% by weight manganese, from about 0.8 to about 4% magnesium, from 0 to about 0.25% by weight zinc, 0 to 0.1% by weight chromium with the balance being aluminum and its usual impurities.

20. A method for manufacturing an aluminum alloy sheet in a continuous, in-line, one step process, comprising: strip casting an aluminum alloy feedstock to form a strip; rolling the strip to less than 0.054 inch to a final product gauge that will not be further rolled; and coiling the rolled strip, the process is conducted without intermediate heating that causes recrystallization, wherein the aluminum alloy is rapidly cooled along a temperature time line that does not intersect the curves shown on FIG. 3 to prevent substantial precipitation of alloying elements, the aluminum alloy comprises from about 0 to 0.6% by weight silicon, from 0 to about 0.8% by weight iron, from 0 to about 0.6% by weight copper, from about 0.2 to about 1.5% by weight manganese, from about 0.8 to about 4% magnesium, from 0 to about 0.25% by weight zinc, 0 to 0.1% by weight chromium with the balance being aluminum and its usual impurities.

21. A method for manufacturing an aluminum alloy sheet in accordance with claim 20 wherein the final gauge is about the same as that for can body sheet or blanks used for cups.

22. A two-step process for manufacturing an aluminum alloy sheet to a final product gauge that does not require additional rolling, the first step comprising: strip, or slab casting an aluminum alloy feedstock; and rolling the feedstock to form a strip or a slab, wherein the aluminum alloy is rapidly cooled along a temperature time line that does not intersect the curves shown on FIG. 3 to prevent substantial precipitation of alloying elements; the second step comprising cold rolling the strip or slab to make a final product that does not require additional rolling, both steps being performed without intermediate heating that causes recrystallization.

23. A method for manufacturing an aluminum alloy sheet in accordance with claim 22 wherein the sheet is coiled after the first step and is coiled after the second step.

24. A method for manufacturing an aluminum alloy sheet in accordance with claim 22 wherein the final gauge of the strip is about the same as that for can body sheet or blanks used for cups.

25. A method for manufacturing an aluminum alloy sheet in accordance with claim 22 wherein the cast slab is less than 1 inch thick.

26. A method for manufacturing an aluminum alloy sheet in accordance with claim 22 wherein the cast strip is between 0.01 and 0.2 inches thick.

27. A method for manufacturing an aluminum alloy sheet in accordance with claim 22 wherein the total reduction in thickness by rolling is 40–99%.

28. A method for manufacturing an aluminum alloy sheet in accordance with claim 22 wherein the final gauge of the strip is less than 0.12 inch.

29. A method for manufacturing an aluminum alloy sheet in accordance with claim 22 wherein the final gauge of the strip is about 0.0114 in.

30. A method for manufacturing an aluminum alloy sheet in accordance with claim 22 wherein the final product gauge is about 0.054 in.

31. A method for manufacturing an aluminum alloy sheet in accordance with claim 22 wherein the rolling step comprises hot rolling in the first step.

32. A method for manufacturing an aluminum alloy sheet in accordance with claim 22 wherein the slab or strip is cooled by the hot rolling in the first step.

33. A method for manufacturing an aluminum alloy sheet in accordance with claim 22 wherein the slab or strip is cooled to below 350° F. upon exiting the rolling operation in the first step.

34. A method for manufacturing an aluminum alloy sheet in accordance with claim 22 wherein the slab or strip is cooled to below 405° F. upon exiting the rolling operation in the first step.

35. A method for manufacturing an aluminum alloy sheet in accordance with claim 22 wherein the time required to cool the slab or strip is less than 30 seconds in the first step.

36. A method for manufacturing an aluminum alloy sheet in accordance with claim 22 wherein the time required to cool the slab or strip is less than 10 seconds in the first step.

37. A method for manufacturing an aluminum alloy sheet, to a final product gauge that does not require additional rolling, in a two-step process, the first step comprises: strip casting an aluminum alloy feedstock; rolling the feedstock to less than 0.054 inch to form a strip; and coiling the rolled strip, wherein the aluminum alloy is rapidly cooled along a temperature time line that does not intersect the curves shown on FIG. 3 to prevent substantial precipitation of alloying elements; the second step comprises: uncoiling, cold rolling, and coiling the strip from the first step, both steps being performed without intermediate heating that causes recrystallization.

38. A method for manufacturing an aluminum alloy sheet in accordance with claim 37 wherein the final gauge is about the same as that for can body sheet or blanks used for cups.

39. A method for manufacturing an aluminum alloy sheet in accordance with claim 37 wherein a convoluted die is employed to cut non-circular blanks from the strip.

40. A method for manufacturing an aluminum alloy sheet in accordance with claim 37 wherein the aluminum alloy comprises from about 0 to 0.6% by weight silicon, from 0 to about 0.8% by weight iron, from 0 to about 0.6% by weight copper, from about 0.2 to about 1.5% by weight manganese, from about 0.8 to about 4% magnesium, from 0 to about 0.25% by weight zinc, 0 to 0.1% by weight chromium with the balance being aluminum and its usual impurities.

41. A method for manufacturing an aluminum alloy sheet in a continuous, in-line, one step process, comprising: strip, or slab casting an aluminum alloy feedstock to form a slab or a strip; and rolling to a final product gauge which does not require additional rolling; the process is conducted without intermediate heating that causes recrystallization; wherein the aluminum alloy is rapidly cooled in less than 30 seconds to a temperature sufficient to prevent substantial precipitation of alloying elements.

42. A two-step process for manufacturing an aluminum alloy sheet to a final product gauge that does not require additional rolling, the first step comprising: strip, or slab casting an aluminum alloy feedstock; and rolling the feedstock to form a strip or a slab, wherein the aluminum alloy is rapidly cooled in less than 30 to a temperature sufficient to prevent substantial precipitation of alloying elements; the second step comprising cold rolling the strip or slab to make a final product that does not require additional rolling, both steps being performed without intermediate heating that causes recrystallization.

43. A method for manufacturing an aluminum alloy sheet in accordance with claims 41 or 42 wherein the final product gauge of the strip is about 0.01 14 in.

44. A method for manufacturing an aluminum alloy sheet in accordance with claim 41 or 42 wherein the final product gauge of the strip is less than about 0.054 in.

45. A method for manufacturing an aluminum alloy sheet in accordance with claim 41 or 42 wherein the slab or strip is cooled to below 405° F. upon exiting the rolling operation.

46. A method for manufacturing an aluminum alloy sheet in accordance with claim 41 or 42 wherein the aluminum alloy comprises from about 0 to 0.6% by weight silicon, from 0 to about 0.8% by weight iron, from 0 to about 0.6% by weight copper, from about 0.2 to about 1.5% by weight manganese, from about 0.8 to about 4% magnesium, from 0 to about 0.25% by weight zinc, 0 to 0.1% by weight chromium with the balance being aluminum and its usual impurities.

47. A method in accordance with the claims 1, 20, 22, 37, 41, or 42 further comprising forming the alloy into a cup.

48. A method in accordance with the claims 1, 20, 22, 37, 41, or 42 further comprising forming the alloy into a can.

* * * * *